73-151 SR
7/20/82 OR 4,339,946

United States Patent [19] [11] 4,339,946
Cole [45] Jul. 20, 1982

[54] HYDRAULIC DEPTH INDICATOR FOR HYDRAULIC DRILLING MACHINES

[75] Inventor: Thomas F. Cole, Vancouver, Wash.

[73] Assignee: Hughes Tool Company, Houston, Tex.

[21] Appl. No.: 100,597

[22] Filed: Dec. 5, 1979

[51] Int. Cl.[3] ..... E21B 47/04
[52] U.S. Cl. ..... 73/151; 173/21
[58] Field of Search ..... 73/151, 151.5; 116/264; 173/21; 175/202, 40

[56] References Cited

U.S. PATENT DOCUMENTS 3,651,871 3/1972 Greene ..... 173/21
3,921,447 11/1975 Howard ..... 73/151
4,195,699 4/1980 Rogers et al. ..... 73/151.5

*Primary Examiner*—Jerry W. Myracle
*Attorney, Agent, or Firm*—Robert A. Felsman

[57] ABSTRACT

A hydraulically operated earth boring machine, improved with a flowmeter and indicator to show the instantaneous and the greatest depth of the drilling tool.

3 Claims, 1 Drawing Figure

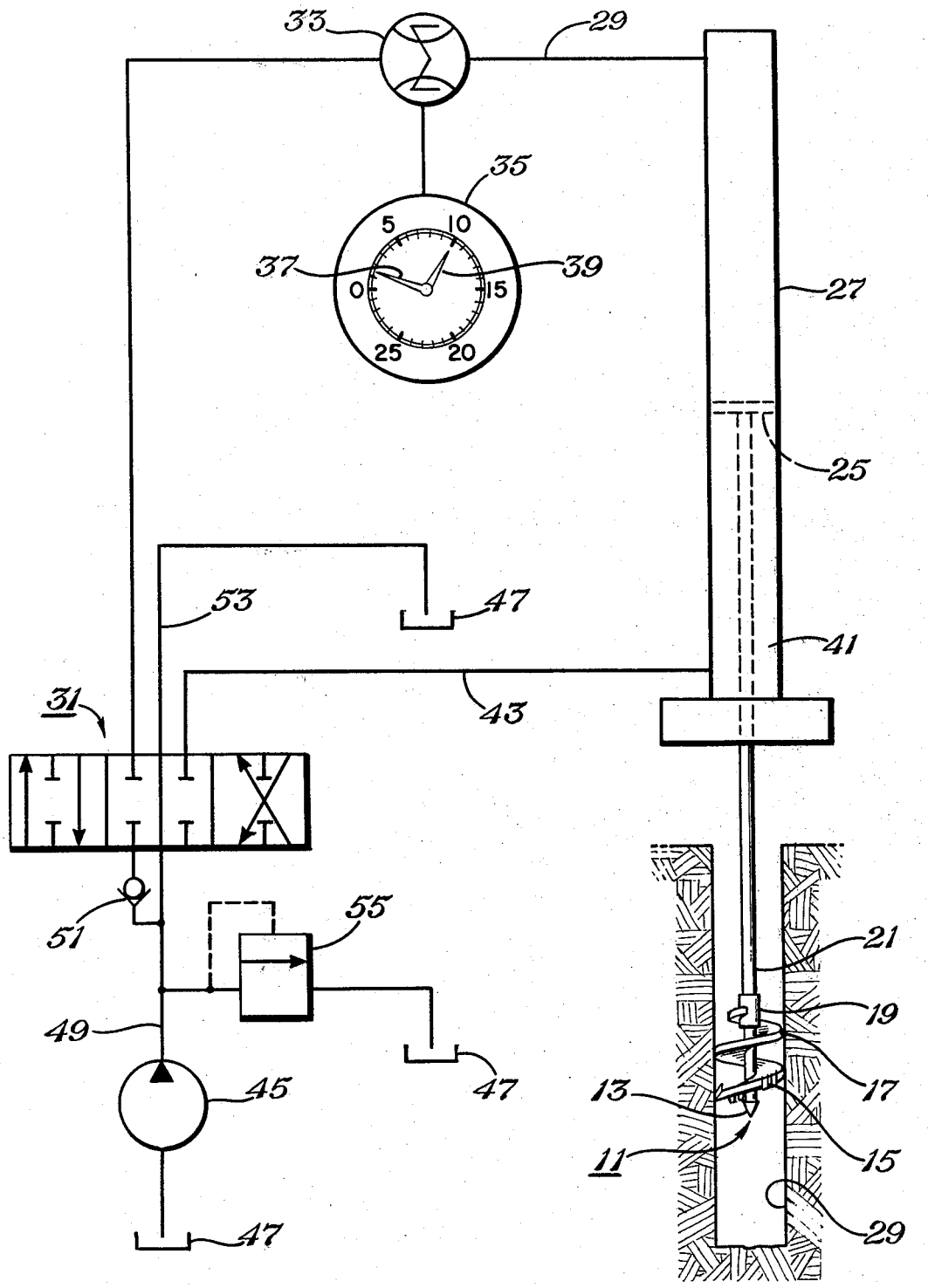
33
29
35
5
10
37
39
0
15
25
20
27
25
53
47
41
31
43
51
55
21
19
49
47
45
17
13
15
11
29
47

HYDRAULIC DEPTH INDICATOR FOR HYDRAULIC DRILLING MACHINES

BACKGROUND OF THE INVENTION

1. Field of the Invention

This invention relates in general to devices for indicating the depth of a hole drilled by an earth boring machine, particularly of the type utilizing a hydraulic cylinder for raising and lowering the drilling tool.

2. Description of the Prior Art

One type of machine for drilling holes for foundations, utility poles, and the like, utilizes a hydraulic cylinder for moving an auger in and out of the hole. A piston is located in the cylinder and connected to a kelly for moving the kelly longitudinally in response to hydraulic fluid pressure. An auger or other type of drilling tool is connected to the bottom of the kelly, which is rotatably driven. An example of this type drilling machine is disclosed in U.S. Pat. No. 3,525,404, "Rotary Drilling Rig With Direct Power Drive and Simplified Controls", E. F. Newman et al., Aug. 25, 1970.

It is advantageous to know the hole depth during drilling. The operator has to pull the auger from the hole after drilling every two or so feet in order to spin spoil from the auger flights. When returning the auger through the hole, damage can result if the bottom of the hole is struck too forcefully. Such accidents can be avoided if the operator has knowledge of the depth of the hole and the instantaneous locations of the end of the auger.

Since the kelly is enclosed in the hydraulic cylinder, the depth of the hole is difficult to detect visually. There is one patented depth measuring system in a hydraulically operated drilling machine, U.S. Pat. No. 3,651,871, "Drilling Rig Depth Control", Palmer G. Greene, Mar. 28, 1972. In this system depth is monitored by recording the length traveled by the drill pipe supporting member, comparing the length traveled with a predetermined length, and producing a signal when the two are equal. The signals are utilized to determine the total length of the drill pipe in the hole.

CROSS-REFERENCE TO RELATED APPLICATION

This application is related in the overall result achieved to the application of Mig Allen Howard, "Electronic Depth Indicator For Hydraulic Drilling Machines", Ser. No. 081,726, filed Oct. 4, 1979. This application is also assigned to the assignee of the present application, Hughes Tool Company of Houston, Tex.

SUMMARY OF THE INVENTION

It is the general object of this invention to provide a hydraulic hole depth determining device for a hydraulic drilling machine with the capability of indicating to the operator when the cutting tool is nearing bottom when returning for further drilling.

In accordance with this object, a hydraulic flow meter is provided for use with a hydraulic drilling machine to determine hold depth. The device is of the type which includes means for measuring the quantity of fluid flowing to the hydraulic cylinder of the machine, typically the measurement being made between a control valve downstream from a fluid pump and the hydraulic cylinder. Indicator means are provided and are calibrated in terms of depth of hole reached by the drilling machine. In a preferred form the indicator means has a dial with indicia corresponding to depth of hole reached by the drilling tool. A first pointer means is connected with the flowmeter to indicate depth of the drilling tool, and a second pointer means is used to indicate the greatest depth reached by the drilling tool.

Additional objects, features and advantages will become apparent in the following description.

BRIEF DESCRIPTION OF THE DRAWING

The sole FIGURE in the drawing is a schematic illustration of a depth determining system constructed in accordance with the principles of the invention.

DESCRIPTION OF THE PREFERRED EMBODIMENT

Earth boring machines of the type for which the invention is disclosed herein are especially suitable are disclosed generally in U.S. Pat. No. 3,525,404, "Rotary Drilling Rig With Direct Power Drive And Simplified Controls", E. F. Newman, et al., Aug. 25, 1970. The disclosure in this patent is incorporated by reference with the disclosure herein for the purpose of providing a detailed description of one form of a drilling machine to which the invention herein may be applied. It should be understood, however, that there are a variety of drilling machines to which the invention may be applied, and it is not limited to use solely with the particular form of machine disclosed in U.S. Pat. No. 3,525,404.

With reference to the drawing forming a part of this application, disclosed therein is a drilling tool 11 in the form of a conventional auger having a pilot bit 13 and teeth 15 along a portion of the auger flights 17, all of which is releasably connected by means of a box and pin 19 to a kelly 21 adapted for rotation with drive means, one form of which is shown in U.S. Pat. No. 3,525,404.

The kelly 21 is connected with the piston 25 adapted for reciprocal movement within the hydraulic cylinder 27 to enable selective positioning of the drilling tool 11 to form the borehole 29.

Although not disclosed in the drawing herein, but as may be seen with reference to U.S. Pat. No. 3,525,404, the drilling machine utilizes rotary drive means to permit selective rotation of the drilling tool 11 in either the clockwise or the counterclockwise direction.

A hydraulic line 29 extends between the hydraulic cylinder 27 and a valve means 31. Located in the hydraulic line 29 between the hydraulic cylinder 27 and the valve means 31 is a flowmeter 33 to measure fluid flow through the line 29. Fluid flowmeters are well known, and commercially available, one form of which is manufactured and sold by Controlotron Corporation of Farmingdale, N.Y., the Series 240 Ultrasonic Flowmeter, which is adapted to clamp onto the hydraulic line or pipe for detecting and indicating flow of liquids by passing ultrasonic sound pulses through the liquid using a set of transducers clamped to the outside of the pipe. This technique is thought to be independent of liquid temperature, viscosity, turbulence and corrosivity. Further, it is thought to be accurate to one percent and has optional digital or analog readouts. The clamp on installation requires no calibration or cutting of metal and can be done in a short period of time by nontechnical personnel. In addition, the Series 240 Ultrasonic flowmeter indicators include high and low flow alarms or controls.

Another form of flowmeter is manufactured and sold by Moore Products Co. of Spring House, Pa., the "Moore SSPH" fluidic flowmeter, which is described in the Moore Bulletin 1400. In this meter the body of the meter is a fluidic oscillator whose frequency is linear with volume flow rate. The oscillations are detected by a flush mounted sensor and are amplified and conditioned by the electronics to provide a digital pulse output for totalizing and an analog output, linear with flow rate.

Associated with the flowmeter 33 is an indicator means 35 which is calibrated in this instance to indicate the depth below the surface of borehole 29 reached by the extremity of the drilling tool 11. Indicia in the form of arabic numerals on the face of the indicator means designate, in this instance, depth in feet. A first pointer 37, operable by signals from the flowmeter 33, indicates the depth in feet reached by the extremity of the drilling tool 11 and is actuated to automatically return toward zero depth as the drilling tool is removed from the borehole. Thus, indicator 37 provides instantaneous and continuous information on the location of the extremity of the drilling tool 11. A second pointer 39 is, in this instance, adapted to be moved clockwise by the first pointer 37 as hole depth increases. Unlike the first pointer 37, however, pointer 39 does not return toward zero depth as the drilling tool 11 is removed from the borehole. Rather, it remains stationary to indicate the greatest depth reached by the drilling tool. Hence, its purpose is to indicate the depth of the borehole as distinguished from the location of the extremity of the drilling tool 11.

Valve means 31 may be referred to as a "Trip Directional Control Valve". It may be similar in function and in operation to that disclosed in FIG. 5 of U.S. Pat. No. 3,525,404. Thus, it is adapted to control the flow of fluid through a lower chamber 41 in the hydraulic cylinder 27 through the hydraulic line 43, as well as through the upper chamber through line 29.

A pump 45 receives fluid from a source 47 and provides pressurized fluid through a hydraulic line 49 leading to the valve means 31. A check valve 51 and another hydraulic line 53 leading back to the fluid supply 47 prevents backflow against the pump 45. Further, a relief valve means 55 enables the return of fluid through the hydraulic line 49 to the fluid supply 47.

In operation, the pump 45 is energized to pump fluid from the fluid source 47 to the hydraulic line 49 and through hydraulic lines 29, 43 in a direction and in an amount controlled by the position of the valve means 31. Hence, the piston 25 in the hydraulic cylinder 27 may be raised or lowered to establish the selected movement of the drilling tool 11.

Fluid flowing through hydraulic line 29 to the hydraulic cylinder 27 is detected by the flowmeter 33 such that the first pointer 37 of indicator 35 provides information to the operator of the machine on the location of the extremity of the drilling tool 11. Further, the second pointer 39 is used to indicate the greatest depth reached by the drilling tool, and thus provides information on the depth of the borehole 29. Consequently, as the drilling tool 11 is moved in and out of the hole during operation, the operator can be apprised by the second pointer 39 of the depth of the hole, and simultaneously, can be apprised of the location of the extremity of the drilling tool 11 by pointer 37. Such information can be utilized by the operator to recognize when advancement into the borehole should be ceased and to prevent accidental and unintentional forceful movement of the drilling tool against the bottom of the borehole. As a consequence, greater control over the machine can be effected and accidental damage to the machine or its operator minimized.

While the invention has been shown in only one of its forms, it should be apparent to those skilled in the art that it is not thus limited but is susceptible to various forms and modifications.

I claim:

1. A depth determining apparatus for an earth boring machine of the type having a cylinder, a piston carried in the cylinder, a rotatable drive kelly connected with the piston and adapted to support a drilling tool, the improvement which comprises in combination:

a fluid source;

a hydraulic line connecting the fluid source with the hydraulic cylinder;

a pump connected with the hydraulic line to provide pressurized fluid to the hydraulic cylinder;

valve means between the pump and the hydraulic cylinder in the hydraulic line to control fluid flow to the cylinder;

a flowmeter in the hydraulic line between the valve and the hydraulic cylinder to measure fluid flow through the line;

indicator means connected with the flowmeter, calibrated in terms of depth of hole reached by the drilling tool.

2. A depth determining apparatus for an earth boring machine of the type having a cylinder, a piston carried in the cylinder, a rotatable drive kelly connected with the piston and adapted to support a drilling tool, the improvement which comprises in combination:

a fluid source;

a hydraulic line connecting the fluid source with the hydraulic cylinder;

a pump connected with the hydraulic line to provide pressurized fluid to the hydraulic cylinder;

valve means between the pump and the hydraulic cylinder in the hydraulic line to control fluid flow to the cylinder;

flow detection means between the valve and the hydraulic cylinder to detect the flow through the line;

indicator means connected with the flow detection means calibrated in terms of depth of hole reached by the drilling tool.

3. A depth determining apparatus for an earth boring machine of the type having a cylinder, a piston carried in the cylinder, a rotatable drive kelly connected with the piston and adapted to support a drilling tool, the improvement which comprises in combination:

a fluid source;

a hydraulic line connecting the fluid source with the hydraulic cylinder;

a pump connected with the hydraulic line to provide pressurized fluid to the hydraulic cylinder;

valve means between the pump and the hydraulic cylinder in the hydraulic line to control fluid flow to the cylinder;

flow detection means between the valve and the hydraulic cylinder to detect the flow through the line;

indicator means in the form of a dial with indicia corresponding to depth of hole reached by the drilling tool, the indicator means being positioned to measure flow to and from the cylinder;

a first pointer means connected with the dial to indicate depth of the drilling tool; and a second pointer means to indicate the depth of the borehole.

* * * * *